US008600272B2

(12) United States Patent
Furuya

(10) Patent No.: US 8,600,272 B2
(45) Date of Patent: Dec. 3, 2013

(54) DEVELOPING DEVICE AND IMAGE FORMING APPARATUS

(75) Inventor: Satoru Furuya, Tokyo (JP)

(73) Assignee: Oki Data Corporation, Tokyo (JP)

( * ) Notice: Subject to any disclaimer, the term of this patent is extended or adjusted under 35 U.S.C. 154(b) by 263 days.

(21) Appl. No.: 12/958,557

(22) Filed: Dec. 2, 2010

(65) Prior Publication Data

US 2011/0135345 A1 Jun. 9, 2011

(30) Foreign Application Priority Data

Dec. 3, 2009 (JP) ..... 2009-275034

(51) Int. Cl.
*G03G 15/08* (2006.01)

(52) U.S. Cl.
USPC ..... 399/281; 399/50; 399/170; 399/311

(58) Field of Classification Search
USPC ..... 399/50, 168, 170, 115, 311, 272, 281
See application file for complete search history.

(56) References Cited

U.S. PATENT DOCUMENTS

| | | | | |
|---|---|---|---|---|
| 6,353,720 | B1 * | 3/2002 | Sakai et al. | 399/234 |
| 2008/0220361 | A1 * | 9/2008 | Uchino et al. | 430/109.5 |
| 2009/0060533 | A1 * | 3/2009 | Yamaguchi | 399/27 |

FOREIGN PATENT DOCUMENTS

| | | | |
|---|---|---|---|
| JP | 07-333996 | | 12/1995 |
| JP | 10-254215 | A | 9/1998 |
| JP | 2005-352084 | A | 12/2005 |
| JP | 2008-090038 | A | 4/2008 |

OTHER PUBLICATIONS

Keithley, Volume and Surface Resistivity Measurements of Insulating Material Using Model 6517A Electrometer/High Resistance Meter, Keithley Instruments Inc, 2001.*

* cited by examiner

*Primary Examiner* — Walter L Lindsay, Jr.
*Assistant Examiner* — Roy Y Yi
(74) *Attorney, Agent, or Firm* — Kubotera & Associates, LLC

(57) ABSTRACT

A developing device includes a developer supplying member for supplying developer; and a developer supporting member for supplying the developer supplied from the developer supplying member onto a static latent image supporting member. The developer supplying member includes an outer circumferential portion having an electrical resistivity between $1.2\times10^4$ and $1.0\times10^8\Omega$.

19 Claims, 10 Drawing Sheets

| | Ex. 13 | Ex. 14 | Ex. 15 | Ex. 16 | Ex. 17 | Ex. 18 | Ex. 19 |
|---|---|---|---|---|---|---|---|
| Developing roller | Dv1 | Dv2 | Dv3 | Dv4 | Dv4 | Dv4 | Dv3 |
| Electrical resistivity (Ω) | $4.35\times10^5$ | $8.29\times10^6$ | $6.09\times10^6$ | $4.32\times10^8$ | $4.32\times10^8$ | $4.32\times10^8$ | $6.09\times10^6$ |
| Remaining potential (V) | 1 | 15 | 22 | 36 | 38 | 36 | 22 |
| Toner supplying roller | Sp0-C | Sp0-C | Sp0-C | Sp0-C | Sp0-C | Sp0-C | Sp0-C |
| Electrical resistivity (Ω) | $1.8\times10^9$ | $1.8\times10^3$ | $1.8\times10^3$ | $1.8\times10^3$ | $1.8\times10^9$ | $1.8\times10^9$ | $1.8\times10^9$ |
| Blurred image | ○ | ○ | ○ | × | × | × | ○ |
| Fog | × | × | × | ○ | ○ | ○ | × |
| Toner supplying roller | Sp1-C | Sp1-C | Sp2-C | Sp3-C | Sp2-C | Sp1-C | Sp1-C |
| Electrical resistivity (Ω) | $8.8\times10^7$ | $8.8\times10^7$ | $7.6\times10^5$ | $1.9\times10^4$ | $7.6\times10^5$ | $8.8\times10^7$ | $8.8\times10^7$ |
| Blurred image | ○ | ○ | ○ | ○ | ○ | ○ | ○ |
| Fog | ○ | ○ | ○ | ○ | ○ | ○ | ○ |

| Ex. 20 | Ex. 21 | Ex. 22 | Ex. 23 | Ex. 24 | CEx. 3 | CEx. 4 |
|---|---|---|---|---|---|---|
| Dv3 | Dv2 | Dv2 | Dv1 | Dv1 | Dv5 | Dv6 |
| $6.09\times10^6$ | $8.29\times10^6$ | $8.29\times10^6$ | $4.35\times10^5$ | $4.35\times10^5$ | $5.71\times10^9$ | $1.12\times10^9$ |
| 22 | 15 | 15 | 1 | 1 | 44 | 75 |
| Sp0-C | Sp0-C | Sp0-C | Sp0-C | Sp0-C | Sp0-C | Sp0-C |
| $1.8\times10^9$ | $1.8\times10^3$ | $1.8\times10^3$ | $1.8\times10^3$ | $1.8\times10^3$ | $1.8\times10^3$ | $1.8\times10^3$ |
| ○ | ○ | ○ | ○ | ○ | × | × |
| × | × | × | × | × | ○ | ○ |
| Sp3-C | Sp2-C | Sp3-C | Sp2-C | Sp3-C | Sp3-C | Sp3-C |
| $1.9\times10^4$ | $7.6\times10^5$ | $1.9\times10^4$ | $7.6\times10^5$ | $1.9\times10^4$ | $1.9\times10^4$ | $1.9\times10^4$ |
| ○ | ○ | ○ | ○ | ○ | × | × |
| ○ | ○ | ○ | ○ | ○ | ○ | ○ |

| | Ex. 1 | Ex. 2 | Ex. 3 | Ex. 4 | Ex. 5 | Ex. 6 | Ex. 7 |
|---|---|---|---|---|---|---|---|
| Developing roller | Dv1 | Dv2 | Dv3 | Dv4 | Dv4 | Dv4 | Dv3 |
| Electrical resistivity (Ω) | $4.35\times10^{6}$ | $8.29\times10^{6}$ | $6.09\times10^{8}$ | $4.32\times10^{8}$ | $4.32\times10^{8}$ | $4.32\times10^{8}$ | $6.09\times10^{8}$ |
| Remaining potential (V) | 1 | 15 | 22 | 36 | 36 | 36 | 22 |
| Toner supplying roller | Sp0-I | Sp0-I | Sp0-I | Sp0-I | Sp0-I | Sp0-I | Sp0-I |
| Electrical resistivity (Ω) | $8.9\times10^{3}$ | $8.9\times10^{3}$ | $8.9\times10^{3}$ | $8.9\times10^{3}$ | $8.9\times10^{3}$ | $8.9\times10^{3}$ | $8.9\times10^{3}$ |
| Blurred image | ○ | ○ | ○ | × | × | × | ○ |
| Fog | × | × | × | ○ | ○ | ○ | × |
| Toner supplying roller | Sp1-I | Sp1-I | Sp2-I | Sp3-I | Sp2-I | Sp1-I | Sp1-I |
| Electrical resistivity (Ω) | $7.6\times10^{7}$ | $7.6\times10^{7}$ | $8.3\times10^{5}$ | $1.2\times10^{4}$ | $8.3\times10^{5}$ | $7.6\times10^{7}$ | $7.6\times10^{7}$ |
| Blurred image | ○ | ○ | ○ | ○ | ○ | ○ | ○ |
| Fog | ○ | ○ | ○ | ○ | ○ | ○ | ○ |

| Ex. 8 | Ex. 9 | Ex. 10 | Ex. 11 | Ex. 12 | CEx. 1 | CEx. 2 |
|---|---|---|---|---|---|---|
| Dv3 | Dv2 | Dv2 | Dv1 | Dv1 | Dv5 | Dv6 |
| $6.09\times10^{8}$ | $8.29\times10^{6}$ | $8.29\times10^{6}$ | $4.35\times10^{6}$ | $4.35\times10^{6}$ | $5.71\times10^{8}$ | $1.12\times10^{8}$ |
| 22 | 15 | 15 | 1 | 1 | 44 | 75 |
| Sp0-I | Sp0-I | Sp0-I | Sp0-I | Sp0-I | Sp0-I | Sp0-I |
| $8.9\times10^{3}$ | $8.9\times10^{3}$ | $8.9\times10^{3}$ | $8.9\times10^{3}$ | $8.9\times10^{3}$ | $8.9\times10^{3}$ | $8.9\times10^{3}$ |
| ○ | ○ | ○ | ○ | ○ | × | × |
| × | × | × | × | × | ○ | ○ |
| Sp3-I | Sp3-I | Sp3-I | Sp2-I | Sp2-I | Sp3-I | Sp3-I |
| $1.2\times10^{4}$ | $8.3\times10^{5}$ | $1.2\times10^{4}$ | $8.3\times10^{5}$ | $1.2\times10^{4}$ | $1.2\times10^{4}$ | $1.2\times10^{4}$ |
| ○ | ○ | ○ | ○ | ○ | × | × |
| ○ | ○ | ○ | ○ | ○ | ○ | ○ |

FIG. 8

| | Ex. 13 | Ex. 14 | Ex. 15 | Ex. 16 | Ex. 17 | Ex. 18 | Ex. 19 |
|---|---|---|---|---|---|---|---|
| Developing roller | Dv1 | Dv2 | Dv3 | Dv4 | Dv4 | Dv4 | Dv3 |
| Electrical resistivity (Ω) | $4.35\times10^{6}$ | $8.29\times10^{6}$ | $6.09\times10^{6}$ | $4.32\times10^{6}$ | $4.32\times10^{6}$ | $4.32\times10^{6}$ | $6.09\times10^{6}$ |
| Remaining potential (V) | 1 | 15 | 22 | 36 | 38 | 38 | 23 |
| Toner supplying roller | Sp0-C | Sp0-C | Sp0-C | Sp0-C | Sp0-C | Sp0-C | Sp0-C |
| Electrical resistivity (Ω) | $1.8\times10^{3}$ | $1.8\times10^{3}$ | $1.8\times10^{3}$ | $1.8\times10^{3}$ | $1.8\times10^{3}$ | $1.8\times10^{3}$ | $1.8\times10^{3}$ |
| Blurred image | ○ | ○ | ○ | × | × | × | ○ |
| Fog | × | × | × | ○ | ○ | ○ | × |
| Toner supplying roller | Sp1-C | Sp1-C | Sp2-C | Sp3-C | Sp2-C | Sp1-C | Sp1-C |
| Electrical resistivity (Ω) | $8.8\times10^{7}$ | $8.8\times10^{7}$ | $7.6\times10^{8}$ | $1.9\times10^{4}$ | $7.6\times10^{6}$ | $8.8\times10^{7}$ | $8.8\times10^{7}$ |
| Blurred image | ○ | ○ | ○ | ○ | ○ | ○ | ○ |
| Fog | ○ | ○ | ○ | ○ | ○ | ○ | ○ |

| Ex. 20 | Ex. 21 | Ex. 22 | Ex. 23 | Ex. 24 | CEx. 3 | CEx. 4 |
|---|---|---|---|---|---|---|
| Dv3 | Dv2 | Dv2 | Dv1 | Dv1 | Dv5 | Dv6 |
| $6.09\times10^{6}$ | $8.29\times10^{6}$ | $8.29\times10^{6}$ | $4.35\times10^{6}$ | $4.35\times10^{6}$ | $5.71\times10^{8}$ | $1.12\times10^{8}$ |
| 22 | 15 | 15 | 1 | 1 | 44 | 75 |
| Sp0-C | Sp0-C | Sp0-C | Sp0-C | Sp0-C | Sp0-C | Sp0-C |
| $1.8\times10^{3}$ | $1.8\times10^{3}$ | $1.8\times10^{3}$ | $1.8\times10^{3}$ | $1.8\times10^{3}$ | $1.8\times10^{3}$ | $1.8\times10^{3}$ |
| ○ | ○ | ○ | ○ | ○ | × | × |
| × | × | × | × | × | ○ | ○ |
| Sp3-C | Sp2-C | Sp3-C | Sp2-C | Sp3-C | Sp3-C | Sp3-C |
| $1.9\times10^{4}$ | $7.6\times10^{8}$ | $1.9\times10^{4}$ | $7.6\times10^{7}$ | $1.9\times10^{6}$ | $1.9\times10^{4}$ | $1.9\times10^{4}$ |
| ○ | ○ | ○ | ○ | ○ | × | × |
| ○ | ○ | ○ | ○ | ○ | ○ | ○ |

FIG. 10

DEVELOPING DEVICE AND IMAGE FORMING APPARATUS

BACKGROUND OF THE INVENTION AND RELATED ART STATEMENT

The present invention relates to an image forming apparatus and a developing device disposed in the image forming apparatus.

In a conventional image forming apparatus of an electrophotography type, a developing device is provided with a toner supplying roller made of a silicone material such as a silicone rubber and the like (refer to Patent Reference). Accordingly, it is possible to press the toner supplying roller against a developing roller with an increased pressing force at an abutting portion (a nip portion) thereof, so that a large amount of toner can be physically contacted with a surface of the developing roller. As a result, it is possible to obtain a toner layer with a large thickness on the developing roller, thereby preventing a density variation (a blurred image).

Patent Reference Japanese Patent Publication No. 07-333996

In the conventional image forming apparatus, in order to increase an operational speed of the developing device or decrease a load torque thereof, when the toner supplying roller is made of a urethane material with a low hardness, it is difficult to physically contact a large amount of toner with the developing roller. In this case, it is necessary to stably supply an electric field to the nip portion. Further, it is necessary to form the developing roller using a material with a fast response to the external electric field and a small dielectric constant, that is, a small remaining charge property. Accordingly, it is possible to form an image without the density variation (the blurred image).

In the conventional developing device described above, however, when the developing roller is formed of a material with the small remaining charge property, the developing roller tends to exhibit an effect of releasing electric charges of charged toner. Accordingly, when the developing roller has a remaining charge property better than a target level, a fog tends to occur on a white sheet. As a result, it is necessary to precisely control the remaining charge property of the developing roller within a specific desired range, and it is difficult to constantly balance an acceptable performance with respect to the density variation and the fog.

In view of the problems described above, an object of the present invention is to provide a developing device and an image forming apparatus capable of solving the problems of the conventional developing device. In the present invention, a developer supplying member includes a foamed member having an electrical resistivity between $1.9\times10^4$ and $7.6\times10^7\Omega$. Accordingly, it is possible to achieve a good performance with respect to the density variation and the fog.

Further objects and advantages of the invention will be apparent from the following description of the invention.

SUMMARY OF THE INVENTION

In order to attain the objects described above, according to the present invention, a developing device includes a developer supplying member for supplying developer; and a developer supporting member for supplying the developer supplied from the developer supplying member onto a static latent image supporting member. The developer supplying member includes an outer circumferential portion having an electrical resistivity between $1.2\times10^4$ and $1.0\times10^8\Omega$.

In the present invention, as described above, the developing device includes the developer supplying member including the outer circumferential portion having the electrical resistivity between $1.2\times10^4$ and $1.0\times10^8\Omega$. Accordingly, it is possible to achieve a good performance with respect to a density variation and a fog.

BRIEF DESCRIPTION OF THE DRAWINGS

FIG. 8 is a table showing results of an evaluation of the developing device according to the first embodiment of the present invention;

FIG. 10 is a table showing results of an evaluation of a developing device according to a second embodiment of the present invention.

DETAILED DESCRIPTION OF PREFERRED EMBODIMENTS

Hereunder, embodiments of the present invention will be explained with reference to the accompanying drawings.

First Embodiment

Figure 1:
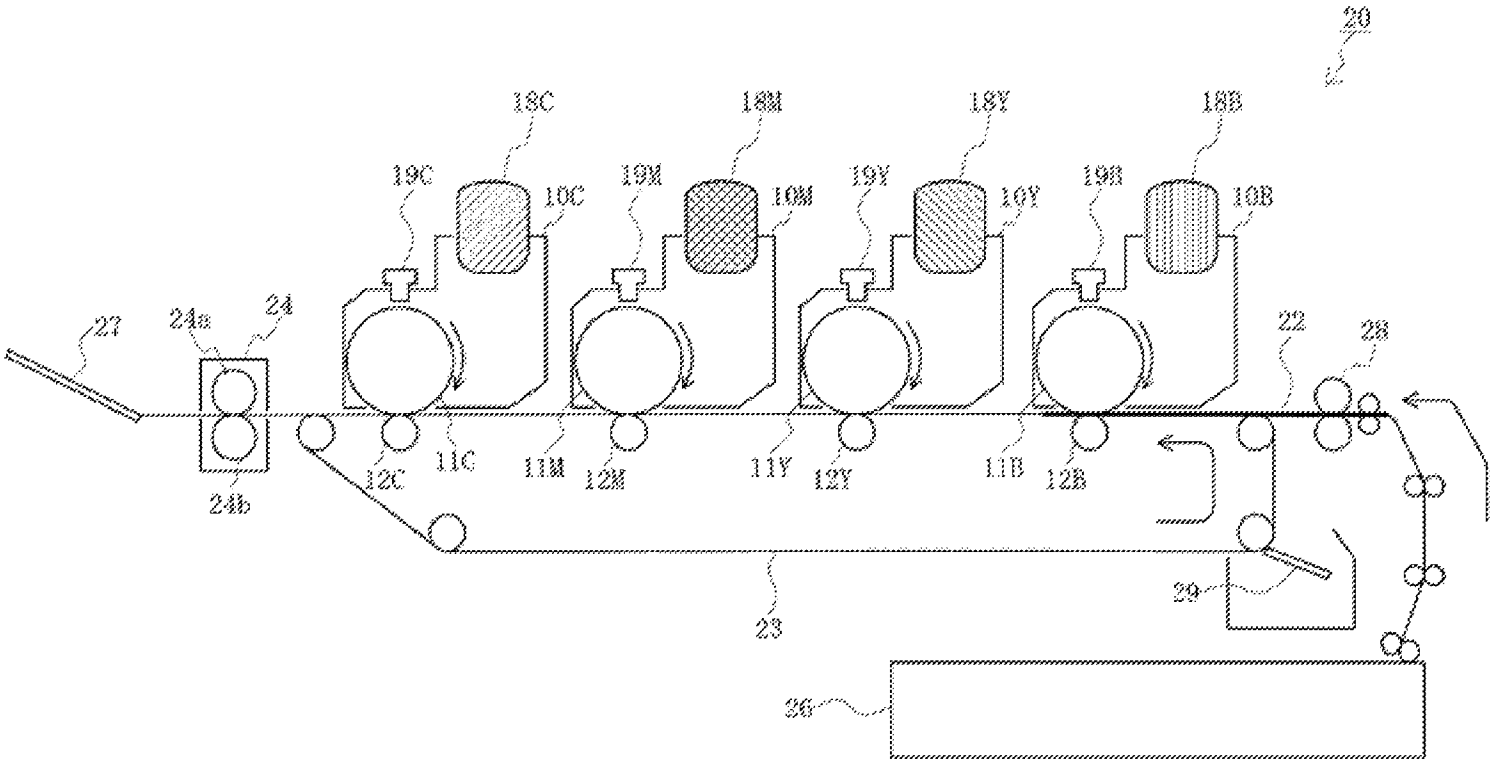
FIG. 1 is a schematic sectional view showing a configuration of an image forming apparatus according to a first embodiment of the present invention.
Figure 2:
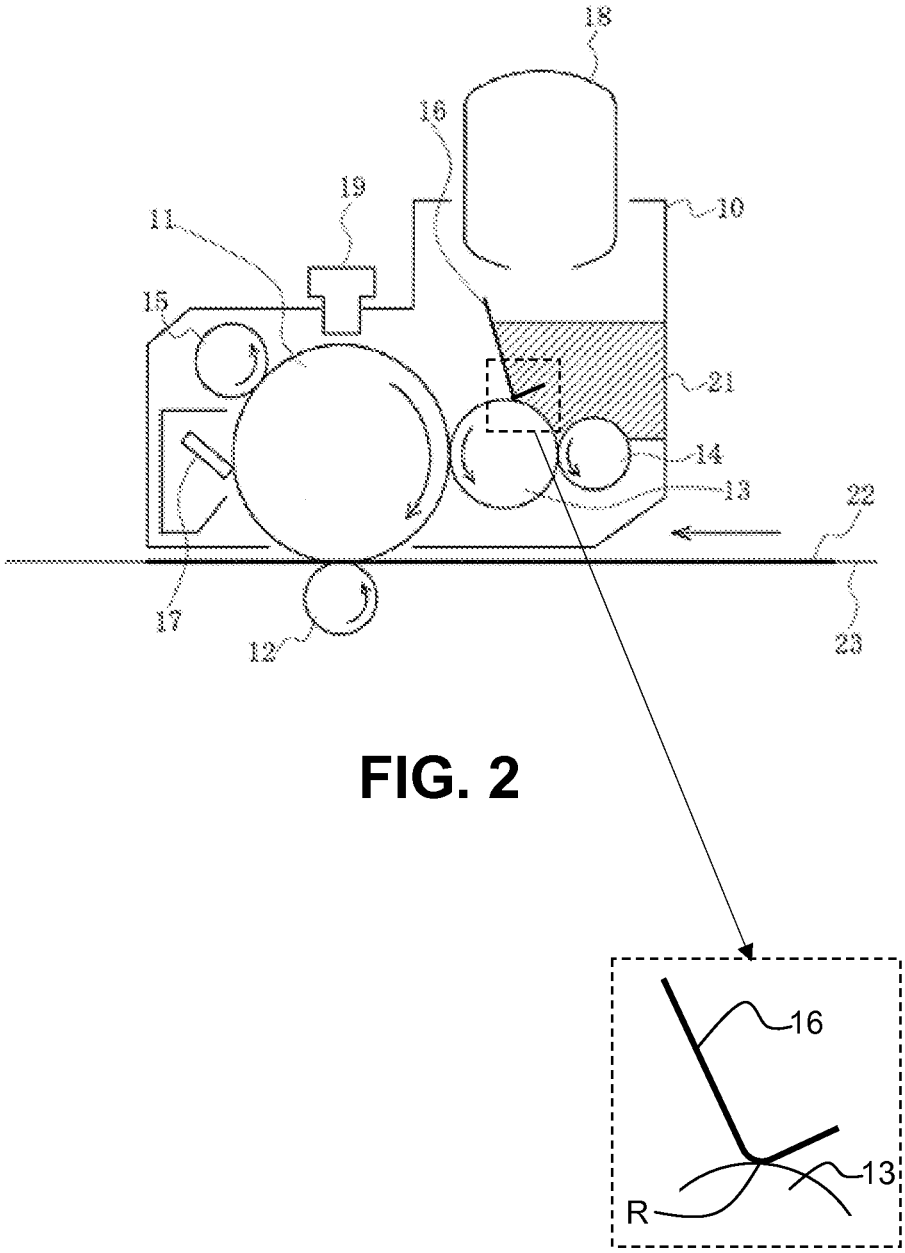
FIG. 2 is a schematic sectional view showing a configuration of a developing device of the image forming apparatus according to the first embodiment of the present invention.

A first embodiment of the present invention will be explained. FIG. 1 is a schematic sectional view showing a configuration of an image forming apparatus 20 according to the first embodiment of the present invention. FIG. 2 is a schematic sectional view showing a configuration of a developing device 10 of the image forming apparatus 20 according to the first embodiment of the present invention.

In the embodiment, the image forming apparatus 20 includes, for example, a printer, a facsimile, a copier, a multi function product having various functions, and the like. The image forming apparatus 20 is configured as an electro-photography printer capable of forming an image in an electrophotography method. The image forming apparatus 20 may be capable of forming a monochrome image or forming a color image (the image forming apparatus 20 is a color printer in the embodiment).

As shown in FIG. 1, the image forming apparatus 20 includes the developing devices 10B, 10M, 10Y, and 10C corresponding to four colors of black (B), yellow (Y), magenta (M), and cyan (C). The developing devices 10B, 10M, 10Y, and 10C are sequentially arranged along a transportation path of a recording sheet 22 as a print medium in a transportation direction (from a right side to a left side in FIG. 1).

In the embodiment, the developing devices 10B, 10M, 10Y, and 10C have basically an identical configuration. Accordingly, in the following description, the developing devices 10B, 10M, 10Y, and 10C are collectively referred to as the developing device 10. As for other components, when it is necessary to differentiate the components according to the four colors of black (B), yellow (Y), magenta (M), and cyan (C), the components are designated with reference numerals with characters B, Y, M, and C. Otherwise, the components are collectively referred to as a single component designated with a reference numeral without characters B, Y, M, and C.

In the embodiment, in addition to the developing devices 10B, 10M, 10Y, and 10C, the image forming apparatus 20 further includes a tray 26 for retaining the recording sheet 22 and a fixing device 24. A register roller 28 is provided for transporting the recording sheet 22. A transfer belt 23 as an intermediate transfer member and transfer rollers 12B, 12M, 12Y, and 12C are arranged below the developing devices 10B, 10M, 10Y, and 10C.

In the embodiment, after the recording sheet 22 retained in the tray 26 in a stacked state is separated and transported one by one, the register roller 28 transports the recording sheet 22 at a specific timing, so that toner images formed with the developing devices 10B, 10M, 10Y, and 10C are transferred to the recording sheet 22. When the recording sheet 22 is transported in the fixing device 24, a fixing roller 24*a* and a heating roller 24*b* of the fixing device 24 performs a fixing process. Accordingly, the toner images are melted at a high temperature, and are pressed against the recording sheet 22, thereby fixing the toner images to the recording sheet 22. After the toner mages are fixed to the recording sheet 22, the recording sheet 22 is discharged from the image forming apparatus 20 and placed on a discharge tray 27.

In the embodiment, when the recording sheet 22 is not transported due to a sheet supply problem and the like, and toner is attached to the transfer belt 23, a transfer belt cleaning device 29 removes and collects toner.

As shown in FIG. 2, the developing device 10 includes a photosensitive drum 11 as a static latent image supporting member formed in a drum shape and having an organic photosensitive member on a surface thereof; a charging roller 15 arranged around the recording sheet 22 to be rotatable for charging the surface of the photosensitive drum 11; an exposure device 19 for exposing the surface of the photosensitive drum 11; a developing roller 13 as a developer supporting member arranged to be rotatable for supplying toner to the surface of the photosensitive drum 11; and the transfer roller 12 for transferring the toner image on the surface of the photosensitive drum 11 to the recording sheet 22. It is noted that the charging roller 15, the developing roller 13, and the transfer roller 12 are arranged to contact with or press against the surface of the photosensitive drum 11.

In the embodiment, a cleaning blade 17 is arranged to contact with the surface of the photosensitive drum 11, so that the cleaning blade 17 scrapes off waste toner such as fog toner, remaining toner after transfer, and the like. A space is provided around the cleaning blade 17 for collecting waste toner thus scraped off, and waste toner is transported to a waste toner collector.

In the embodiment, the exposure device 19 is provided with an LED (Light Emitting Diode) head for irradiating light on the surface of the photosensitive drum 11 according to an image signal, thereby forming a static latent image on the surface.

In the embodiment, the developing device 10 further includes a toner supplying roller 14 as a developer supplying member arranged to be rotatable for charging toner 21 as developer supplied from a toner cartridge 18 and supplying the toner 21 to the developing roller 13; and a layer regulating blade 16 arranged to contact with a surface of the developing roller 13 for forming a thin layer of the toner 21 supplied from the toner supplying roller 14. As shown in the enlarged view in FIG. 2, a distal end portion of the layer regulating blade 16 is curved to have a curved portion R.

In the embodiment, the developing roller 13 is arranged such that the developing roller 13 is pushed into the photosensitive drum 11 by a length of 0.1 mm. Further, the toner supplying roller 14 and the developing roller 13 are arranged such that a distance between centers of core metals thereof becomes 14.75 mm. Further, the photosensitive drum 11, the developing roller 13, the toner supplying roller 14, and the charging roller 15 are arranged to rotate in arrow directions in FIG. 2, respectively. It is noted that the charging roller 15 follows a rotation of the photosensitive drum 11 to rotate.

In the embodiment, the transfer belt 23 is arranged to contact with the photosensitive drum 11. Accordingly, the toner image is directly transferred to the recording sheet 22 from the surface of the photosensitive drum 11 through the transfer belt 23.

Figure 3:
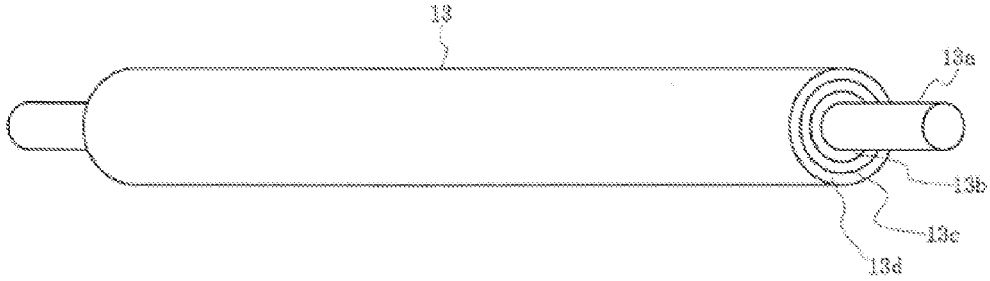
FIG. 3 is a schematic perspective view showing a developing roller of the developing device according to the first embodiment of the present invention.

A configuration of the developing roller 13 will be explained in more detail next. FIG. 3 is a schematic perspective view showing the developing roller 13 of the developing device 10 according to the first embodiment of the present invention.

In the embodiment, the developing roller 13 is formed of a core metal 13*a* as a shaft member made of aluminum or stainless steel (SUS); and an elastic layer 13*b* disposed on an outer circumferential surface of the core metal 13*a*. Further, an intermediate layer 13*c* is formed on an outer circumferential surface of the elastic layer 13*b*, and a surface layer 13*d* is formed on an outer circumferential surface of the intermediate layer 13*c*. The core metal 13*a* may be coated with an adhesive or a primer to increase an adhesive property between the core metal 13*a* and the elastic layer 13*b*. The core metal 13*a* has an outer diameter of 10 mm, and the developing roller 13 has an outer diameter of 16 mm.

In the embodiment, the elastic layer 13*b* of the developing roller 13 may be formed of a material such as an ethylene-propylene-diene rubber (EPDM), a styrene-butadiene rubber (SBR), a silicone rubber, a polyurethane type elastomer, and the like. An additive such as a conductive agent, silicone oil, and the like may be added as necessary. The conductive agent as the additive includes carbon black, graphite, potassium titanate, iron oxide, titanium oxide ($TiO_2$), zinc oxide (ZnO), tin oxide ($SnO_2$), and the like.

In the embodiment, the intermediate layer 13*c* of the developing roller 13 may be formed of a material such as a polyurethane type elastomer, an acrylonitril-butadiene rubber, a hydrogenated acrylonitril-butadiene rubber, a chloroprene rubber (CR), natural rubber, a butadiene rubber (BR), a butyl rubber (IIR), a hydrindantin rubber (ECO, CO), nylon, and the like. An additive such as particles may be added to the material of the intermediate layer 13*c* for imparting a specific surface roughness. The particles for imparting a specific surface roughness include silica, a urethane resin, a polyamide resin, a fluorine resin, an acryl resin, a silicone resin, and the like. The particles for imparting a specific surface roughness preferably have an average diameter in a range of 5 to 15 μm, and are added in a range of 10 to 40 weight % with respect to 100 weight % of the material of the intermediate layer 13*c*.

In the embodiment, the surface layer 13*d* of the developing roller 13 may be formed of a material such as an acryl resin, an epoxy resin, a phenol resin, a polyester resin, a polyamide resin, a silicone resin, a urethane resin, and the like. The material may be modified, grafted, or polymerized to be a block copolymer, and may be used alone or a combination with other resins.

An additive such as a conductive agent, a charge control agent, and the like may be added to the material of the surface layer 13*d*. The charge control agent may include quaternary ammonium salt, borate salt, an azine type (a nigrosine type) compound, an azo compound, an oxynaphthoic acid metal complex, a surfactant agent (an anion type, a cation type, or a nonionic type), and the like. Further, the material of the surface layer 13*d* may contain a stabilizing agent, an ultraviolet light absorbing agent, an anti-static agent, a reinforcing material, a flow promoter, a releasing agent, a pigment, a dye, a flame retardant agent, and the like.

Figure 4:
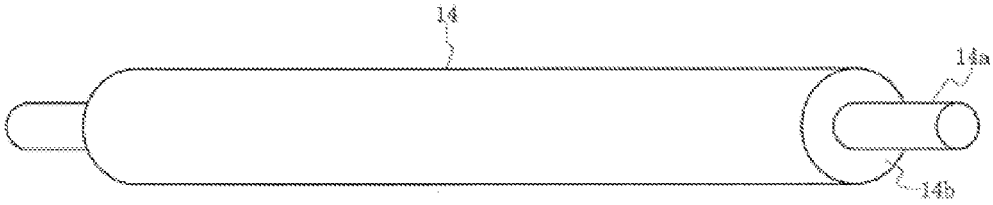
FIG. 4 is a schematic perspective view showing a supplying roller of the developing device according to the first embodiment of the present invention.

A configuration of the toner supplying roller 14 will be explained next. FIG. 4 is a schematic perspective view showing the toner supplying roller 14 of the developing device 10 according to the first embodiment of the present invention.

In the embodiment, the toner supplying roller 14 is formed of a core metal 14*a* made of stainless steel (SUS) and an elastic foamed layer 14*b* as an outer circumferential portion disposed on an outer circumferential surface of the core metal 14*a*. The core metal 14*a* has an outer diameter of 6 mm, and the toner supplying roller 14 has an outer diameter of 15.5 mm.

In the embodiment, the elastic foamed layer 14*b* of the toner supplying roller 14 is formed of a soft foamed member having continuous foam cells, which is foamed and cured after a polyol component, a polyisocyanate, a foaming agent, and a catalyst are mixed and stirred.

In the embodiment, the polyol component may include a polyether polyol and a polyester polyol containing a polymer polyol. The polymer polyol is a compound having a polymerized chain and a plurality of hydroxyl groups at chain ends and the likes. More specifically, the polymer polyol is formed of a polyether polyol grafted with a compound having an ethylene unsaturated bonding such as a polyacrylonitrile, stylene, and a polymethacrylonitrile.

In the embodiment, the polyisocyanate may include various polyisocyanates of an aromatic type, an aliphatic type, and a cycloaliphatic type. The aromatic type polyisocyanate may include tolylene diisocyanate (TDI), 4, 4'-diphenylmethane diisocyanate (MDI), 1,5-naphthalene diisocyanate, paraphenylene diisocyanate, and m-xylene diisocyanate. The aliphatic type polyisocyanate may include 1,6-hexamethylene diisocyanate (HDI), 2,2,4-trimethylene hexamethylene diisocyanate, 2,4,4-trimethylene hexamethylene diisocyanate, and the like. The cycloaliphatic type polyisocyanate may include isophorone diisocyanate, 4,4'-dicyclohexylmethane diisocyanate, hydrogenated MDI, and the like. The polyisocyanate may be used alone or mixed with other type of polyisocyanate. The aromatic type polyisocyanate, the aliphatic type polyisocyanate, and the cycloaliphatic type polyisocyanate may be mixed or modified.

In the embodiment, the foaming agent is mainly formed of pure water, and may include methylene chloride, pentane, cyclopentane, hexane, cyclohexane, chloromethane, a chlorofluorocarbon type compound, carbon dioxide, and the like. The catalyst may also contain an amine type catalyst, in particular, a tertiary amine (such as triethylene diamine, dimethylethanol amine, N,N',N'-trimethyl aminoethyl piperazine, and the like), and an organic metal compound such as octylic acid stannum (stannum octate).

In the embodiment, a foaming control agent may be used. The foaming control agent may include an organosiloxane-polyoxyalkylene copolymer, a non-ion type surfactant agent formed of a silicone compound such as a silicone-grease copolymer, a mixture thereof, an anion type surfactant agent such as dodecylbenzenesulfonic acid and potassium lauryl sulfate, a phenol type compound, and the like.

In the embodiment, the elastic foamed layer 14*b* may contain a conductive agent for imparting conductivity through an electron conductivity mechanism. The conductive agent includes carbon black such as furnace black, thermal black, channel black, acethylene black, ketjen black, color black, and the like; powders such as graphite; a fibrous substance; metal powders or fibrous substance of copper, nickel, silver, and the like; a metal oxide such as tin oxide, titanium oxide, indium oxide, and the like; and organic type conductive fine powders made of polyacetylene, polypyrrole, polyaniline, and the like.

Further, the elastic foamed layer 14*b* may contain a conductive agent for imparting conductivity through an ion conductivity mechanism. The conductive agent may include a metal salt in the first group of the periodic system ($L1^+$, $Na^+$, and $K^+$) such as $LiCF_3SO_3$, $NaClO_4$, $LiClO_4$, $LiAsF_6$, $LiBF_4$, NaSCN, KSCN, and NaCl; an electrolyte such as a salt of $NH_4^+$; a metal salt in the second group of the periodic system ($Ca^{++}$ and $K^+$); 1,4-butanediol, ethylene glycol, polyethylene glycol, propylene glycol, and a complex of a polyhydroxy alcohol such as polyethylene glycol and a derivative thereof; ethylene glycol monomethylether; and a complex of a mono alcohol such as ethylene glycol monomethylether and the like.

In the embodiment, the toner 20 is a negatively charged crashed type formed of a non-magnetic one-component, and has an average volume particle size of 5.5 μm. The toner 20 may have a saturated electric charge amount of −44 μC/g. The saturated electric charge may be measured using a charge amount measurement device Q/M Meter Model 210HS (a product of Trek Incorporated) after 4 wt % of the toner 20 and 96 wt % of a silicone coated ferrite carrier (a product of KANTO CHEMICAL CO., INC., an average particle diameter of 90 μm) are mixed for one minute in a ball mill.

In the embodiment, the layer regulating blade 16 is formed of a plate shape member made of a material such as stainless steel (SUS), and has a thickness of 0.08 mm. Further, the layer regulating blade 16 has a contact portion abutting against the developing roller 13 in a curved shape. The curved shape has a curvature radius of 0.5 mm, and the layer regulating blade 16 has a surface roughness of 0.6 μm measured with a ten-point average surface roughness measurement method.

An experiment for evaluating the developing device 10 will be explained next. In the experiment for evaluating the developing device 10, as the developing roller 13 thereof, six developing rollers Dv1 to Dv6 were produced. A method of producing the developing rollers Dv1 to Dv6 will be explained next.

In producing the developing roller Dv1, first, a solution for forming the surface layer 13*d* was prepared using a composition mixture. The composition mixture included 100 parts of an acrylic resin (Baraclon W-248E, a product of Negami Chemical Industrial Co., Ltd.); 40 parts of an acrylic silicone resin (Alon J20, a number average molecular weight of 5,000, a product of TOAGOSEI Co., Ltd.); 25 parts of a carbon black (Printex L6, an average particle size of primary particles 18 nm, conductive index 81, BET relative surface area 265 $m^2/g$, a product of Evonik Degussa Japan Co., Ltd.); 100 parts of tolylene diisocyanate (TDI) (Colonate T-65, a product of Nippon Polyurethane Industry Co., Ltd.); and 15 parts of a polymer type dispersion agent (Solsperse 24000, a product of The Lubrizol Corporation). The composition mixture was dissolved in methylethylketone to obtain the solution having a concentration of 20 wt %.

In the next step, a solution for forming the intermediate layer 13*c* was prepared. First, a composition mixture was prepared. The composition mixture included 100 parts of a polyurethane-type elastomer (UN278, a product of SAKAI CHEMICAL CORPORATION); 30 parts of carbon black; and 10 parts of 4,4'-diphenylmethane diisocyanate (MDI) as a cross-linking agent. The composition mixture was dissolved in methylethylketone to obtain a solution having a concentration of 20 wt %. Then, 20 parts of particles with an average diamater of 10 μm formed of a urethane resin (Barnoc CFB100, a product of DIC Corporation) was mixed and dispersed to obtain the solution for forming the intermediate layer 13*c*.

In the next step, a circular column made of aluminum with a diameter of 12 mm was prepared, and an adhesive was coated on an outer circumferential surface of the circular column. Then, a liquid silicone rubber containing a conductive agent (X-34-264A, a product of Shin-Etsu Chemical Co., Ltd.) was thermally molded using a molding die (190° C.×30 min.), so that the core metal 13*a* (a base roll) with the elastic layer 13*b* was obtained after detaching from the molding die. The core metal 13*a* had an outer diameter of 16 mm.

After the solution for forming the intermediate layer 13*c* was coated on the outer circumferential surface of the core metal 13*a* with the elastic layer 13*b*, the solution was heated and dried, thereby producing the intermediate layer 13*c* on the outer circumferential surface of the elastic layer 13*b*. Further, after the solution for forming the surface layer 13*d* was coated on the outer circumferential surface of the intermediate layer 13*c* with a coat roll method, the solution was heated and dried, thereby producing the surface layer 13*d* on the outer circumferential surface of the intermediate layer 13*c*. Through the steps described above, the developing roller Dv1 having a three-layer structure shown in FIG. 3 was produced as the developing roller 13.

In the developing roller Dv1, the elastic layer 13*b* had a thickness of 3 mm and the intermediate layer 13*c* had a thickness of 15 μm. Further, the surface layer 13*d* had a thickness of 3 μm, a surface roughness Ra of 1.1 μm, and a surface roughness Rz of 5.3 μm.

In producing the developing roller Dv2, similar to the developing roller Dv1, a solution for forming the surface layer 13*d* was prepared using a composition mixture. The composition mixture included the same amounts of the acrylic resin, the acrylic silicone resin, carbon black, tolylene diisocyanate (TDI), and the polymer type dispersion agent as those in the developing roller Dv1, except the ratio of carbon black was 20 parts. The composition mixture was dissolved in methylethylketone to obtain the solution having a concentration of 20 wt %.

The solution for forming the intermediate layer 13*a* and the core metal 13*a* with the elastic layer 13*b* were prepared similar to those in the developing roller Dv1. Further, the intermediate layer 13*a* and the surface layer 13*d* were formed similar to those in the developing roller Dv1.

In the developing roller Dv2, the elastic layer 13*b had a thickness of* 3 mm and the intermediate layer 13*c* had a thickness of 15 μm. Further, the surface layer 13*d* had a thickness of 3 μm, a surface roughness Ra of 1.2 μm, and a surface roughness Rz of 5.8 μm.

In producing the developing roller Dv3, similar to the developing roller Dv2, a solution for forming the surface layer 13*d* was prepared using a composition mixture. The composition mixture included the same amounts of the acrylic resin, the acrylic silicone resin, carbon black, tolylene diisocyanate (TDI), and the polymer type dispersion agent as those in the developing roller Dv2, except the ratio of tolylene diisocyanate (TDI) was 120 parts. The composition mixture was dissolved in methylethylketone to obtain the solution having a concentration of 20 wt %.

The solution for forming the intermediate layer 13*a* and the core metal 13*a* with the elastic layer 13*b* were prepared similar to those in the developing roller Dv2. Further, the intermediate layer 13*a* and the surface layer 13*d* were formed similar to those in the developing roller Dv2.

In the developing roller Dv3, the elastic layer 13*b had a thickness of* 3 mm and the intermediate layer 13*c* had a thickness of 15 μm. Further, the surface layer 13*d* had a thickness of 3 μm, a surface roughness Ra of 1.0 μm, and a surface roughness Rz of 5.2 μm.

In producing the developing roller Dv4, first, a solution for forming the surface layer 13*d* was prepared using a composition mixture. The composition mixture included 25 parts of a melamine resin (SUPER BECKAMINE P-138, a product of DIC Corporation); 10 parts of tolylene diisocyanate (TDI) (Colonate L, a product of Nippon Polyurethane Industry Co., Ltd.); 60 parts of a silicone modified acrylic resin (X-24-798A, a product of Shin-Etsu Chemical Co., Ltd.); and 10 weight parts of a carbon black as the conductive agent (Denkablack HS-100, a product of DENKI KAGAKU KOGYO KABUSHIKI KAISHA). The composition mixture was dissolved in methylethylketone to obtain the solution having a concentration of 20 wt %.

The solution for forming the intermediate layer 13*a* and the core metal 13*a* with the elastic layer 13*b* were prepared similar to those in the developing roller Dv3. Further, the intermediate layer 13*a* and the surface layer 13*d* were formed similar to those in the developing roller Dv3.

In the developing roller Dv4, the elastic layer 13*b* had a thickness of 3 mm and the intermediate layer 13*c* had a thickness of 15 μm. Further, the surface layer 13*d* had a thickness of 3 μm, a surface roughness Ra of 0.9 μm, and a surface roughness Rz of 5.2 μm.

In producing the developing roller Dv5, similar to the developing roller Dv4, a solution for forming the surface layer 13*d* was prepared using a composition mixture. The composition mixture included the same amounts of the melamine resin, tolylene diisocyanate (TDI), the silicone modified acrylic resin, and carbon black as those in the developing roller Dv4, except the ratios of tolylene diisocyanate (TDI) and the silicone modified acrylic resin were 20 parts and 50 parts, respectively. The composition mixture was dissolved in methylethylketone to obtain the solution having a concentration of 20 wt %.

The solution for forming the intermediate layer 13*a* and the core metal 13*a* with the elastic layer 13*b* were prepared similar to those in the developing roller Dv4. Further, the intermediate layer 13*a* and the surface layer 13*d* were formed similar to those in the developing roller Dv4.

In the developing roller Dv5, the elastic layer 13*b had a thickness of* 3 mm and the intermediate layer 13*c* had a thickness of 15 μm. Further, the surface layer 13*d* had a thickness of 3 μm, a surface roughness Ra of 1.0 μm, and a surface roughness Rz of 5.4 μm.

In producing the developing roller Dv6, similar to the developing roller Dv5, a solution for forming the surface layer 13*d* was prepared using a composition mixture. The composition mixture included the same amounts of the melamine resin, tolylene diisocyanate (TDI), the silicone modified acrylic resin, and carbon black as those in the developing roller Dv5, except the ratio of tolylene diisocyanate (TDI) was 30 parts. The composition mixture was dissolved in methylethylketone to obtain the solution having a concentration of 20 wt %.

The solution for forming the intermediate layer 13*a* and the core metal 13*a* with the elastic layer 13*b* were prepared similar to those in the developing roller Dv5. Further, the intermediate layer 13*a* and the surface layer 13*d* were formed similar to those in the developing roller Dv5.

In the developing roller Dv6, the elastic layer 13*b had a thickness of* 3 mm and the intermediate layer 13*c* had a thickness of 15 μm. Further, the surface layer 13*d* had a thickness of 3 μm, a surface roughness Ra of 1.0 μm, and a surface roughness Rz of 5.1 μm.

In the experiment for evaluating the developing device 10, as the toner supplying roller 14 thereof, four toner supplying rollers Sp0-I to Sp3-I were produced. A method of producing the toner supplying rollers Sp0-I to Sp3-I will be explained next.

In producing the toner supplying roller Sp0-I, first, a mixture was prepared. The mixture contained 50 parts of a polyether polyol (GP-3050, a product of Sanyo Chemical Industries, Ltd.); 50 parts of an acrylonitrile-stylene graft polymer polyol (Excenol 941, a product of Asahi Glass Co., Ltd.); 110 parts of tolylene diisocyanate (TDI-80, a mixture of 80 mass % of 2,4-tolylene diisocyanate and 20 mass % of 2,6-tolylene diisocyanate, a product of Mitsui Takeda Chemicals, Inc.); 1.7 parts of pure water; 0.3 part of an amine catalyst (Kaolyzer No. 31, a product of Kao Corporation); 0.2 part of another amine catalyst (Kaolyzer No. 22, a product of Kao Corporation); 2.2 parts of a silicone-type surfactant agent as a foaming control agent (B8110, a product of Goldschmidt Co., Ltd.); and 4.2 parts of an ion conductive agent (lithium perchlorate unhydrate, a product of KANTO CHEMICAL CO., INC.).

In the next step, the mixture was poured in a foaming container having a vertical side length, a lateral side length, and a depth of 500 mm. Then, the mixture was foamed at a room temperature under atmospheric pressure. Afterward, the foaming container was passed through a heating oven to heat the mixture, so that the mixture was reacted and cured, thereby obtaining a soft foamed member. The soft foamed member had an electrical resistivity of $9.6\times10^{9}\Omega\cdot$cm. The soft foamed member became a base member of the outer circumferential portion of the toner supplying roller 14.

In the next step, the soft foamed member was cut into a rectangular member having a vertical side length and a lateral side length of 400 mm and a height of 25 mm, and then the rectangular member was immersed in a conductive processing solution at 20° C. for five minutes. In preparing the conductive processing solution, 34 weight % of a carbon black dispersion solution (Ecomal black, a solid content of 36%, a product of SANYO COLOR WORKS, Ltd.) was added in an acrylic resin emulsion (Nipol 1851, a solid contact of 45%, a product of ZEON CORPORATION), and a mixture was stirred.

In the next step, after water, carbon black, and the acrylic resin were impregnated into foam cells of the rectangular member, the rectangular member of the soft foamed member was passes through a pair of tool rolls arranged with an interval of 0.2 mm, thereby squeezing out an excess amount of the conductive processing solution from the rectangular member of the soft foamed member.

In the next step, the rectangular member was heated and dried in a hot air circulation oven at 100° C. for 60 minutes. Through the heating and drying process, moisture was removed from the rectangular member of the soft foamed member, and the acrylic resin was cross-linked, so that carbon black was strongly adhered to walls of the foam cells, thereby producing a conductive foamed member in a rectangular cubic shape to be used for the elastic foamed layer 14*b*.

In the next step, the conductive foamed member in the rectangular cubic shape was cut into a rectangular column member having a length of 300 mm and a square side surface with one side of 25 mm. Then, a through hole with a diameter of 5 mm was formed at a center of the square side surface, so that the core metal 14*a* passed through the through hole.

In the next step, an adhesive was coated on a surface of the core metal 14*a*, which was made of stainless steel and had a diameter of 6 mm and a length of 272 mm. Then, the core metal 14*a* passed through the through hole and was adhered. Lastly, the elastic foamed layer 14*b* was polished, so that an outer diameter of the elastic foamed layer 14*b* became 15.5 mm, thereby producing the toner supplying roller Sp0-I through the process described above. The toner supplying roller Sp0-I had an electrical resistivity of $8.9\times10^{3}\Omega$.

In producing the toner supplying roller Sp1-I, similar to the toner supplying roller Sp0-I, a mixture was prepared. The mixture included the same amounts of the polyether polyol, the acrylonitrile-stylene graft polymer polyol, tolylene diisocyanate, pure water, the amine catalyst, another amine catalyst, the silicone-type surfactant agent, and the ion conductive agent as those in the toner supplying roller Sp0-I, except the ratio of the ion conductive agent was 0.08 part. A soft foamed member was obtained from the mixture with a method similar to that of the toner supplying roller Sp0-I. The soft foamed member had an electrical resistivity of $1.04\times10^{12}\Omega\cdot$cm.

In the next step, similar to the toner supplying roller Sp0-I, the soft foamed member was cut into a rectangular member, and then the rectangular member was immersed in a conductive processing solution at 20° C. for five minutes. In preparing the conductive processing solution, 26 weight % of a carbon black dispersion solution (Ecomal black, a solid content of 36%, a product of SANYO COLOR WORKS, Ltd.) was added in an acrylic resin emulsion (Nipol 1851, a solid contact of 45%, a product of ZEON CORPORATION), and a mixture was stirred.

In the next step, similar to the toner supplying roller Sp0-I, the rectangular member of the soft foamed member was adhered to the core metal 14*a*, which was made of stainless steel and had a diameter of 6 mm and a length of 272 mm, thereby obtaining the toner supplying roller Sp1-I having an outer diameter of 15.5 mm. The toner supplying roller Sp1-I had an electrical resistivity of $7.6\times10^{7}\Omega$.

In producing the toner supplying roller Sp2-I, similar to the toner supplying roller Sp0-I, a mixture was prepared. The mixture included the same amounts of the polyether polyol, the acrylonitrile-stylene graft polymer polyol, tolylene diisocyanate, pure water, the amine catalyst, another amine catalyst, the silicone-type surfactant agent, and the ion conductive agent as those in the toner supplying roller Sp0-I, except the ratio of the ion conductive agent was 1.0 part. A soft foamed member was obtained from the mixture with a method similar to that of the toner supplying roller Sp0-I. The soft foamed member had an electrical resistivity of $3.16\times10^{10}\Omega\cdot$cm.

In the next step, similar to the toner supplying roller Sp0-I, the soft foamed member was cut into a rectangular member, and then the rectangular member was immersed in a conductive processing solution at 20° C. for five minutes. In preparing the conductive processing solution, 26 weight % of a carbon black dispersion solution (Ecomal black, a solid content of 36%, a product of SANYO COLOR WORKS, Ltd.) was added in an acrylic resin emulsion (Nipol 1851, a solid contact of 45%, a product of ZEON CORPORATION), and a mixture was stirred.

In the next step, similar to the toner supplying roller Sp0-I, the rectangular member of the soft foamed member was adhered to the core metal 14*a*, which was made of stainless steel and had a diameter of 6 mm and a length of 272 mm, thereby obtaining the toner supplying roller Sp2-I having an outer diameter of 15.5 mm. The toner supplying roller Sp2-I had an electrical resistivity of $8.3\times10^5\Omega$.

In producing the toner supplying roller Sp3-I, similar to the toner supplying roller Sp0-I, a mixture was prepared. The mixture included the same amounts of the polyether polyol, the acrylonitrile-stylene graft polymer polyol, tolylene diisocyanate, pure water, the amine catalyst, another amine catalyst, the silicone-type surfactant agent, and the ion conductive agent as those in the toner supplying roller Sp0-I, except the ratio of the ion conductive agent was 1.0 part. A soft foamed member was obtained from the mixture with a method similar to that of the toner supplying roller Sp0-I. The soft foamed member had an electrical resistivity of $1.26\times10^{10}$ Ω·cm.

In the next step, similar to the toner supplying roller Sp0-I, the soft foamed member was cut into a rectangular member, and then the rectangular member was immersed in a conductive processing solution at 20° C. for five minutes. In preparing the conductive processing solution, 34 weight % of a carbon black dispersion solution (Ecomal black, a solid content of 36%, a product of SANYO COLOR WORKS, Ltd.) was added in an acrylic resin emulsion (Nipol 1851, a solid contact of 45%, a product of ZEON CORPORATION), and a mixture was stirred.

In the next step, similar to the toner supplying roller Sp0-I, the rectangular member of the soft foamed member was adhered to the core metal 14*a*, which was made of stainless steel and had a diameter of 6 mm and a length of 272 mm, thereby obtaining the toner supplying roller Sp3-I having an outer diameter of 15.5 mm. The toner supplying roller Sp3-I had an electrical resistivity of $1.2\times10^4\Omega$.

Figure 5:
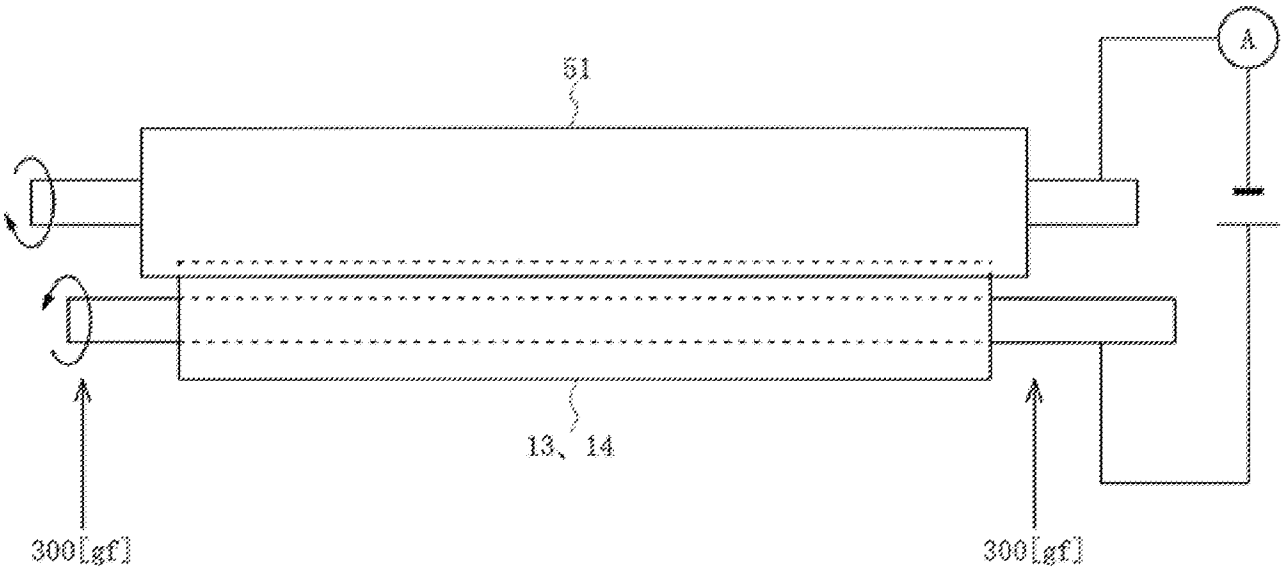
FIG. 5 is a schematic perspective view showing a method of measuring an electrical resistivity of the developing roller and the toner supplying roller of the developing device according to the first embodiment of the present invention.

In the experiment, various physical properties of the developing roller 13 and the toner supplying roller 14 were evaluated. FIG. 5 is a schematic perspective view showing a method of measuring an electrical resistivity of the developing roller 13 and the toner supplying roller 14 of the developing device 10 according to the first embodiment of the present invention.

Figure 6A:
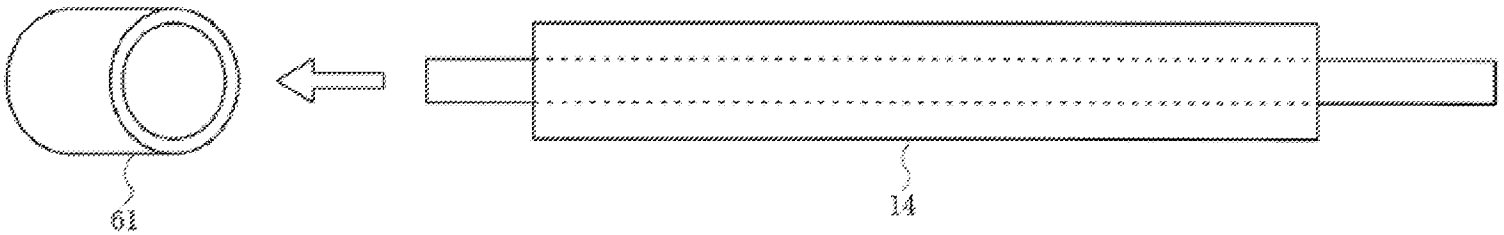
FIGS. 6(*a*) and 6(*b*) are schematic perspective views showing a method of measuring a volume resistivity of a foamed elastic member of the toner supplying roller of the developing device according to the first embodiment of the present invention.
Figure 6B:
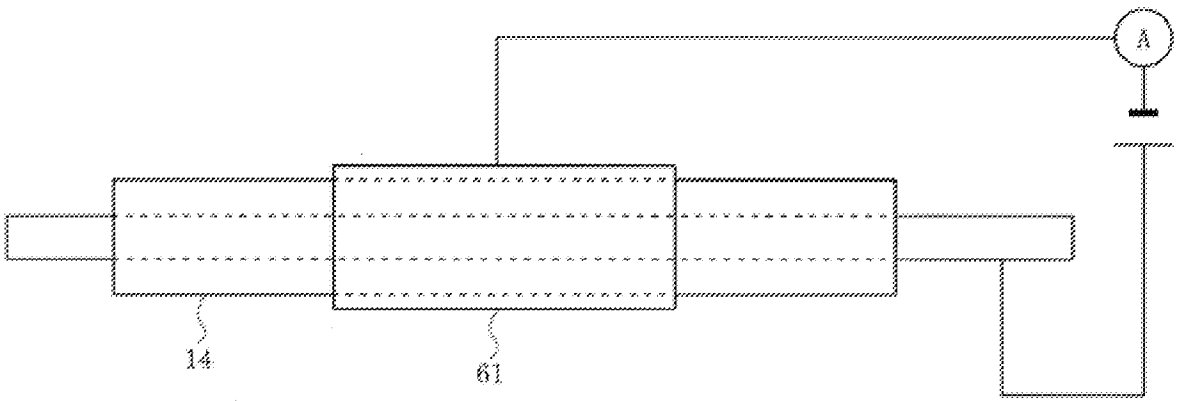
Figure 7:
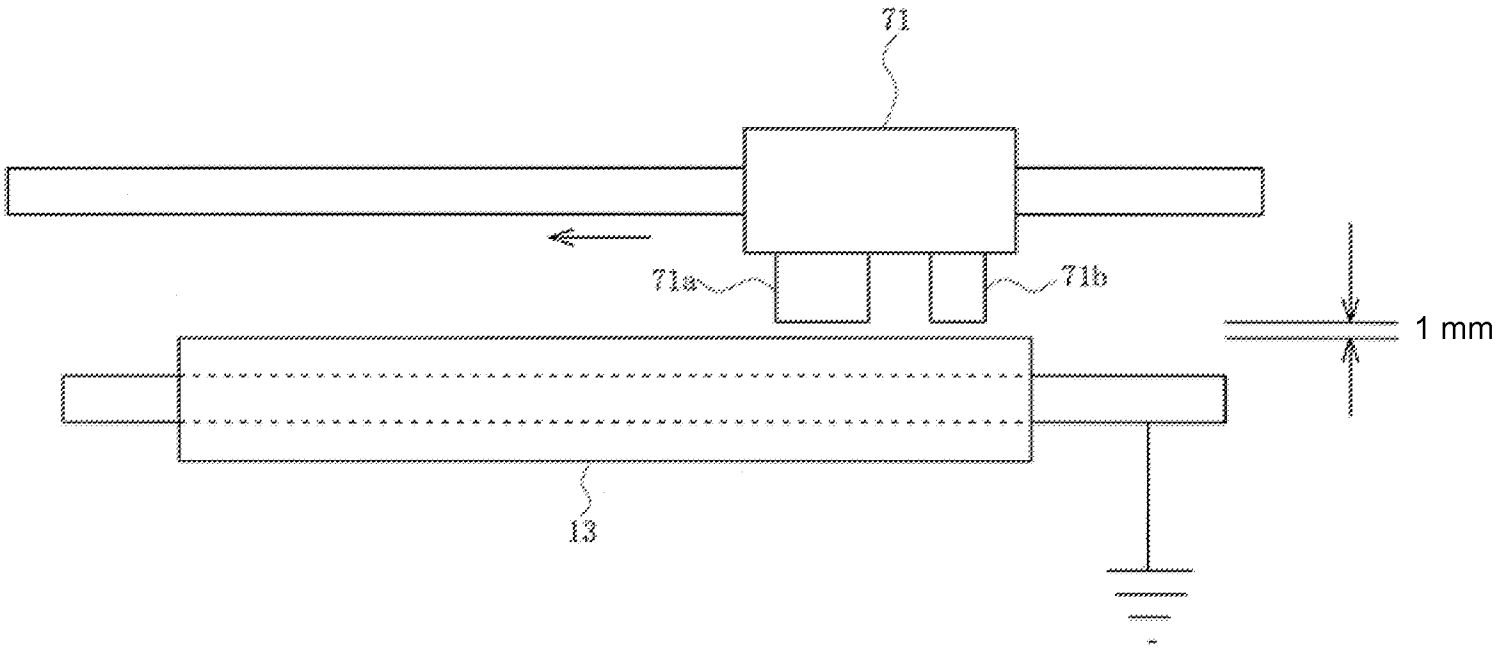
FIG. 7 is a schematic view for showing a method of measuring a remaining potential of the developing roller of the developing device according to the first embodiment of the present invention.

FIGS. 6(*a*) and 6(*b*) are schematic perspective views showing a method of measuring a volume resistivity of the foamed elastic member 14*b* of the toner supplying roller 14 of the developing device 10 according to the first embodiment of the present invention. FIG. 7 is a schematic view for showing a method of measuring a remaining potential of the developing roller 13 of the developing device 10 according to the first embodiment of the present invention.

First, the method of measuring the electrical resistivity of the developing roller 13 and the toner supplying roller 14 of the developing device 10 will be explained.

As shown in FIG. 5, in the electrical resistivity, the developing roller 13 or the toner supplying roller 14 was pressed against a metal cylindrical member 51 being made of stainless steel and having an outer diameter of 30 mm, and the metal cylindrical member 51 was rotated at a speed of 62.5 rpm. Electrodes of a power source were connected to the core metal 13*a* of the developing roller 13 or the core metal of the toner supplying roller 14 and the metal cylindrical member 51, so that a voltage was applied between them. A high resistance meter 4339A (a product of Hewlett-Packard Company) was used for applying the voltage and measuring the electrical resistivity.

The method of measuring the volume resistivity of the foamed elastic layer 14*b* of the toner supplying roller 14 will be explained next. First, the toner supplying roller 14 was processed such that the core metal 14*a* thereof had the outer diameter of 6 mm and the foamed elastic layer 14*b* thereof had the outer diameter of 15.5 mm. Then, as shown in FIG. 6(*a*), a metal pipe 61 made of stainless steel and having a cylindrical shape covered the foamed elastic layer 14*b*.

In the next step, as shown in FIG. 6(*b*), electrodes of a power source were connected to the core metal 14*a* of the toner supplying roller 14 and the metal pipe 61, so that a voltage was applied between them. An ultrahigh resistance meter 8340A (a product of ADC CORPORATION) was used for applying the voltage and measuring the volume resistivity. The volume resistivity of the foamed elastic layer 14*b* was calculated from a length and an inner diameter of the metal pipe 61, and an inner diameter of the foamed elastic layer 14*b* of the toner supplying roller 14.

Next, the method of measuring the remaining potential of the developing roller 13 of the developing device 10 will be explained. As shown in FIG. 7, a measurement head 71 had a corona discharge device 71*a* and a surface potential meter 71*b* arranged to be movable along the developing roller 13 in a longitudinal direction thereof. It is noted that the corona discharge device 71*a* and the surface potential meter 71*b* of the measurement head 71 were arranged to be away from the surface of the developing roller 13 by a distance of 1 mm. In the measurement, the measurement head 71 was moved in an arrow direction, and the corona discharge device 71*a* charged with a voltage of 5 kV. After 0.1 second, the surface potential meter 71*b* measured a potential at a specific location, thereby obtaining the remaining potential. When the remaining potential had a large value, a large amount of electric charges remained, thereby indicating a strong dielectric property.

In the experiment, a printing performance of the image forming apparatus 20 was evaluated. A printing operation of the image forming apparatus 20 will be explained next.

In the experiment, an optical LES type color electrophotography printer MICROLINE 5900 dn (a resolution of 600 DPI, a product of OKI DATA CORPORATION) was used as the image forming apparatus 20. The toner 21 was formed of a non-magnetic one component with a negatively charging crash manufacturing method, and had a volume average particle size of 5.5 μm. Further, the image forming apparatus 20 performed the printing operation under an environment with a room temperature of 23° C. and relative humidity of 45% RH.

A method of evaluating a blurred text (a performance of supplying toner to the developing roller 13) will be explained next. In order to evaluate the blurred text, after a text pattern with an image area density of 100% density was printed on the recording sheet 22, a density of a printed image was measured. More specifically, densities at an upper portion and a lower portion of the recording sheet 22 were measured with a spectrum density meter X-Rite 528 (the product of X-Rite). When a density difference was less than five, the result was represented as good (O). When the image density difference was equal to or greater than five, the result was represented as poor (X).

A method of evaluating a white sheet fog will be explained next. While the image forming apparatus 20 was performing the printing operation on a white sheet, the image forming apparatus 20 was stopped. Then, an adhesive tape (Scotch tape, a product of Sumitomo 3M Limited) was attached to the toner 21 on the photosensitive drum 11 after an image was developed and before the image was transferred, and the adhesive tape was attached to the recording sheet 22 as a white sheet. In the next step, a spectrometer (CM-2600d, a product of KONICA MINOLTA HOLDINGS, INC.) was used for measuring a color value of the recording sheet 22 before and after the adhesive tape was attached. When a difference in the color values ΔE was small, an amount of the toner 21 causing the fog was small. When the difference in the color values was equal to or smaller than 2.0 (ΔE 2.0, a visible low limit), the result was represented as good (o). When the difference in the color values was greater than 2.0 (ΔE>2.0, the visible low limit), the result was represented as poor (X).

Figure 9:
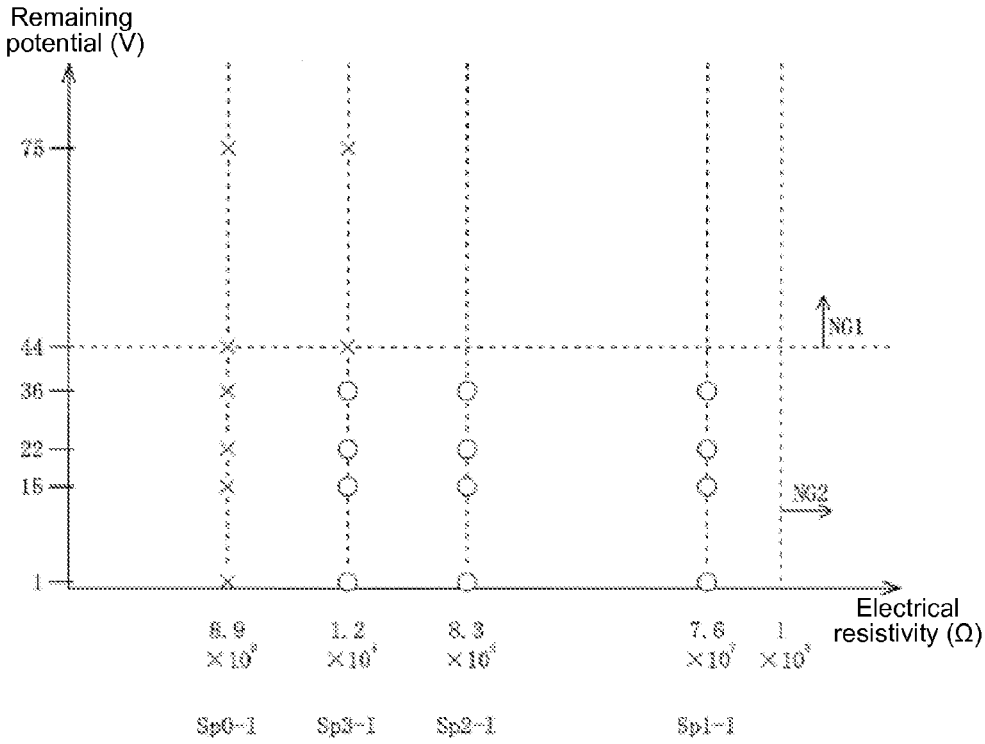
FIG. 9 is a graph showing results of the evaluation of the developing device according to the first embodiment of the present invention.

Results of the evaluation of the developing device 10 will be explained next. FIG. 8 is a table showing the results of the evaluation of the developing device 10 according to the first embodiment of the present invention. FIG. 9 is a graph showing results of the evaluation of the developing device 10 according to the first embodiment of the present invention.

As shown in FIGS. 8 and 9, the table and the graph show the results of examples 1 to 12 (Ex. 1 to Ex. 12) and comparative examples 1 and 2 (CEx. 1 and CEx. 2). In FIGS. 8 and 9, when the results of the blurred image and the fog were both good (o) in FIG. 8, the result was represented as good (o) in FIG. 9. When one of the results of the blurred image and the fog was poor (X) in FIG. 8, the result was represented as poor (X) in FIG. 9.

As shown in FIG. 8, the examples 1 to 12 (Ex. 1 to Ex. 12) used the developing rollers Dv1 to Dv4 as the developing roller 13. In the examples 1 to 12 (Ex. 1 to Ex. 12), when the toner supplying roller Sp0-I with the low electrical resistivity was used as the toner supplying roller 14, i.e., combinations of the developing rollers Dv1 to Dv4 and the toner supplying roller Sp0-I, it was possible to obtain a good result with respect to a density variance (the blurred image), and was not possible to obtain a good result with respect to the fog.

On the other hand, when the toner supplying rollers Sp1-I to Sp3-I with the middle electrical resistivity were used as the toner supplying roller 14, i.e., combinations of the developing rollers Dv1 to Dv4 and the toner supplying rollers Sp1-I to Sp3-I, it was possible to obtain a good result with respect to both the density variance (the blurred image) and the fog.

As shown in FIG. 8, the comparative examples 1 and 2 (CEx. 1 and CEx. 2) used the developing rollers Dv5 and Dv6 as the developing roller 13. In the comparative examples 1 and 2 (CEx. 1 and CEx. 2), when the toner supplying roller Sp0-I with the low electrical resistivity was used as the toner supplying roller 14, or the toner supplying rollers Sp1-I to Sp3-I with the middle electrical resistivity were used as the toner supplying roller 14, i.e., combinations of the developing rollers Dv5 and Dv6 and the toner supplying rollers Sp0-I to Sp3-I, it was possible to obtain a good result with respect to the fog, and was not possible to obtain a good result with respect to the density variance.

In the experiment, the developing rollers Dv5 and Dv6 had the large remaining potential and were capable of accumulating a large amount of electric charges. Accordingly, it was possible to prevent electric charges of the toner 21 from escaping, thereby obtaining the good result with respect to the fog. However, when the developing rollers Dv5 and Dv6 were rotated at a high speed, it was difficult to quickly generate the electric filed at the contact portion (the nip portion) relative to the toner supplying roller 14. Accordingly, it was difficult to stably generate the electric filed and supply the toner 21, thereby causing the density variance.

On the other hand, the developing rollers Dv1 to Dv4 used in the examples 1 to 12 (Ex. 1 to Ex. 12) had the small remaining potential. When the developing rollers Dv1 to Dv4 were rotated at a high speed as the developing roller 13, it was possible to stably generate the electric filed and supply the toner 21, thereby maintaining a stable density.

When the developing rollers Dv1 to Dv4 were combined with the toner supplying rollers Sp1-I to Sp3-I having the middle electrical resistivity, it was possible to prevent the toner electric charges from discharging due to the electric field, or prevent the toner electric charges from leaking to the toner supplying roller 14 and lowering, thereby making it possible to maintain the good result with respect to the fog.

As described above, in the embodiment, when the toner supplying roller 14 includes the foamed elastic layer 14*b* having the electrical resistivity between $1.2\times10^4$ and $7.6\times10^7\Omega$, it is possible to provided the developing device 10 with the good performance with respect to the density variance and the fog.

In the embodiment, in terms of the remaining potential of the developing roller 13, 44 V is normally the upper limit of the potential, at which it is possible to maintain as the remaining potential. Further, at the upper limit of the potential, the toner supplying roller 14 to be combined to the developing roller 13 with the remaining potential of 44 V can deal with and has a similar performance. Further, it is possible to produce a plurality of the toner supplying rollers 14. As shown in FIG. 9, a range in which the remaining potential exceeds the upper limit corresponds to an area designated with NG1.

In the embodiment, in terms of the remaining potential of the developing roller 13, 1 V is the lower limit of the potential. When the remaining potential is less than 1 V, the remaining potential becomes too small, and it is difficult to control the potential.

In the embodiment, the urethane foamed member was used in the experiment as the elastic foamed layer 14*b* having the electric resistivity between $1.2\times10^4$ and $7.6\times10^7\Omega$. As described above, in theory, when the elastic foamed layer 14*b* has the electric resistivity between $1.2\times10^4$ and $1.0\times10^8\Omega$, it is possible to obtain the good result.

In the embodiment, when the developing roller 13 as the developer supporting member has the remaining potential between 1 V and 36 V, it is possible to form an image with good quality with respect to the density variation and the fog.

Further, in the embodiment, the developing roller 13 as the developer supporting member has the electric resistivity between $4.35\times10^6$ and $4.32\times10^8\Omega$, it is possible to form an image with good quality with respect to the density variation and the fog.

In the embodiment, when the toner supplying roller 14 has the electrical resistivity greater than $1\times10^8\Omega$, the electric filed between the developing roller 13 and the toner supplying roller 14 becomes too small. Accordingly, it is difficult to supply a sufficient amount of the toner 21 to the developing roller 13, thereby causing the poor result with respect to the blurred image. Accordingly, it is necessary to set the electrical resistivity of the toner supplying roller 14 less than $1\times10^8\Omega$. As shown in FIG. 9, a range in which the electrical resistivity of the toner supplying roller 14 is greater than the upper limit corresponds to an area designated with NG2.

Second Embodiment

A second embodiment of the present invention will be explained next. In the second embodiment, components similar to those in the first embodiment are designated with the same reference numerals, and explanations thereof are omitted. The components similar to those in the first embodiment provide similar operations and/or similar effects, and explanations thereof are omitted.

Figure 11:
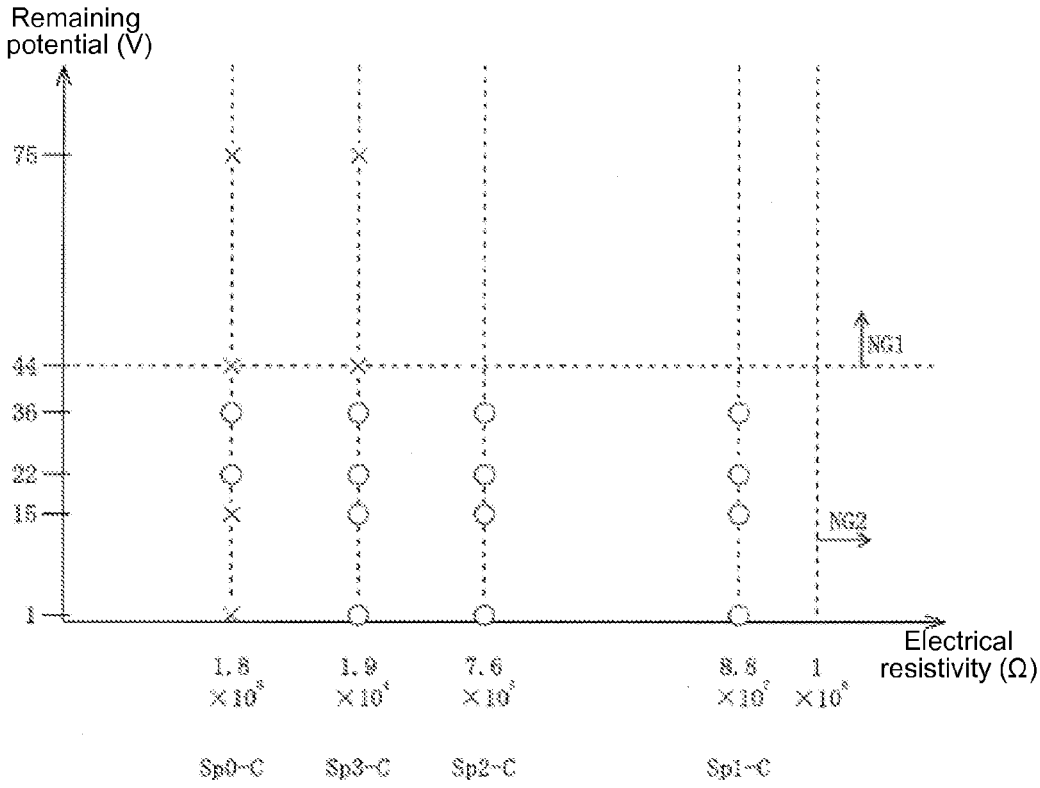
FIG. 11 is a graph showing results of the evaluation of the developing device according to the second embodiment of the present invention.

FIG. 10 is a table showing results of an evaluation of the developing device 10 according to the second embodiment of the present invention. FIG. 11 is a graph showing results of the evaluation of the developing device 10 according to the second embodiment of the present invention.

An experiment for evaluating the developing device 10 will be explained. In the experiment for evaluating the developing device 10, as the toner supplying roller 14 thereof, four toner supplying rollers Sp0-C to Sp3-C were produced. A method of producing the toner supplying rollers Sp0-C to Sp3-C will be explained next. Other components of the developing device 10 are similar to those of the developing device 10 in the first embodiment, and explanations thereof are omitted.

In producing the toner supplying roller Sp0-C, first, a mixture was prepared. The mixture contained 50 parts of a polyether polyol (GP-3050, a product of Sanyo Chemical Industries, Ltd.); 50 parts of an acrylonitrile-stylene graft polymer polyol (Excenol 941, a product of Asahi Glass Co., Ltd.); 110 parts of tolylene diisocyanate (TDI-80, a mixture of 80 mass % of 2,4-tolylene diisocyanate and 20 mass % of 2,6-tolylene diisocyanate, a product of Mitsui Takeda Chemicals, Inc.); 1.7 parts of pure water; 0.3 part of an amine catalyst (Kaolyzer No. 31, a product of Kao Corporation); 0.2 part of another amine catalyst (Kaolyzer No. 22, a product of Kao Corporation); 1.0 parts of a silicone-type surfactant agent as a foaming control agent (B8110, a product of Goldschmidt Co., Ltd.); and 2.0 parts of carbon black (Ketjen black EC600JD, a product of Lion Corporation).

In the next step, the mixture was poured in a foaming container having a vertical side length, a lateral side length, and a depth of 500 mm. Then, the mixture was foamed at a room temperature under atmospheric pressure. Afterward, the foaming container was passed through a heating oven to heat the mixture, so that the mixture was reacted and cured, thereby obtaining a soft foamed member. The soft foamed member became a base member of the outer circumferential portion of the toner supplying roller 14. Accordingly, the base member contained carbon black.

In the next step, the soft foamed member was cut into a rectangular member having a vertical side length and a lateral side length of 400 mm and a height of 25 mm, and then the rectangular member was immersed in a conductive processing solution at 20° C. for five minutes. In preparing the conductive processing solution, 34 weight % of a carbon black dispersion solution (Ecomal black, a solid content of 36%, a product of SANYO COLOR WORKS, Ltd.) was added in an acrylic resin emulsion (Nipol 1851, a solid contact of 45%, a product of ZEON CORPORATION), and a mixture was stirred.

In the next step, after water, carbon black, and the acrylic resin were impregnated into foam cells of the rectangular member, the rectangular member of the soft foamed member was passes through a pair of tool rolls arranged with an interval of 0.2 mm, thereby squeezing out an excess amount of the conductive processing solution from the rectangular member of the soft foamed member.

In the next step, the rectangular member was heated and dried in a hot air circulation oven at 100° C. for 60 minutes. Through the heating and drying process, moisture was removed from the rectangular member of the soft foamed member, and the acrylic resin was cross-linked, so that carbon black was strongly adhered to walls of the foam cells, thereby producing a conductive foamed member in a rectangular cubic shape to be used for the elastic foamed layer 14*b*. In the next step, the conductive foamed member in the rectangular cubic shape was cut into a rectangular column member having a length of 300 mm and a square side surface with one side of 25 mm. Then, a through hole with a diameter of 5 mm was formed at a center of the square side surface, so that the core metal 14*a* passed through the through hole.

In the next step, an adhesive was coated on a surface of the core metal 14*a*, which was made of stainless steel and had a diameter of 6 mm and a length of 272 mm. Then, the core metal 14*a* passed through the through hole and was adhered. Lastly, the elastic foamed layer 14*b* was polished, so that an outer diameter of the elastic foamed layer 14*b* became 15.5 mm, thereby producing the toner supplying roller Sp0-C through the process described above. The toner supplying roller Sp0-C had an electrical resistivity of $1.8\times10^{3}\Omega$.

In producing the toner supplying roller Sp1-C, similar to the toner supplying roller Sp0-C, a mixture was prepared. The mixture included the same amounts of the polyether polyol, the acrylonitrile-stylene graft polymer polyol, tolylene diisocyanate, pure water, the amine catalyst, another amine catalyst, the silicone-type surfactant agent, and carbon black as those in the toner supplying roller Sp0-I, except the ratio of the carbon black was 0.5 part. A soft foamed member was obtained from the mixture with a method similar to that of the toner supplying roller Sp0-C. The soft foamed member had an electrical resistivity of $8.51\times10^{11}$ Ω·cm.

In the next step, similar to the toner supplying roller Sp0-C, the soft foamed member was cut into a rectangular member, and then the rectangular member was immersed in a conductive processing solution at 20° C. for five minutes. In preparing the conductive processing solution, 26 weight % of a carbon black dispersion solution (Ecomal black, a solid content of 36%, a product of SANYO COLOR WORKS, Ltd.) was added in an acrylic resin emulsion (Nipol 1851, a solid contact of 45%, a product of ZEON CORPORATION), and a mixture was stirred.

In the next step, similar to the toner supplying roller Sp0-C, the rectangular member of the soft foamed member was adhered to the core metal 14*a*, which was made of stainless steel and had a diameter of 6 mm and a length of 272 mm, thereby obtaining the toner supplying roller Sp1-C having an outer diameter of 15.5 mm. The toner supplying roller Sp1-C had an electrical resistivity of $8.8\times10^{7}\Omega$.

In producing the toner supplying roller Sp2-C, similar to the toner supplying roller Sp0-C, a mixture was prepared. The mixture included the same amounts of the polyether polyol, the acrylonitrile-stylene graft polymer polyol, tolylene diisocyanate, pure water, the amine catalyst, another amine catalyst, the silicone-type surfactant agent, and carbon black as those in the toner supplying roller Sp0-I, except the ratio of the carbon black was 1.5 parts. A soft foamed member was obtained from the mixture with a method similar to that of the toner supplying roller Sp0-C. The soft foamed member had an electrical resistivity of $6.31\times10^{9}$ Ω·cm.

In the next step, similar to the toner supplying roller Sp0-C, the soft foamed member was cut into a rectangular member, and then the rectangular member was immersed in a conductive processing solution at 20° C. for five minutes. In preparing the conductive processing solution, 26 weight % of a carbon black dispersion solution (Ecomal black, a solid content of 36%, a product of SANYO COLOR WORKS, Ltd.) was added in an acrylic resin emulsion (Nipol 1851, a solid contact of 45%, a product of ZEON CORPORATION), and a mixture was stirred.

In the next step, similar to the toner supplying roller Sp0-C, the rectangular member of the soft foamed member was adhered to the core metal 14*a*, which was made of stainless steel and had a diameter of 6 mm and a length of 272 mm, thereby obtaining the toner supplying roller Sp2-C having an outer diameter of 15.5 mm. The toner supplying roller Sp2-C had an electrical resistivity of $7.6\times10^5\Omega$.

In producing the toner supplying roller Sp3-C, the soft foamed member for producing the toner supplying roller Sp0-C was cut into a rectangular member, and then the rectangular member was immersed in a conductive processing solution at 20° C. for five minutes. In preparing the conductive processing solution, 31 weight % of a carbon black dispersion solution (Ecomal black, a solid content of 36%, a product of SANYO COLOR WORKS, Ltd.) was added in an acrylic resin emulsion (Nipol 1851, a solid contact of 45%, a product of ZEON CORPORATION), and a mixture was stirred.

In the next step, similar to the toner supplying roller Sp0-C, the rectangular member of the soft foamed member was adhered to the core metal 14*a*, which was made of stainless steel and had a diameter of 6 mm and a length of 272 mm, thereby obtaining the toner supplying roller Sp3-C having an outer diameter of 15.5 mm. The toner supplying roller Sp3-C had an electrical resistivity of $1.9\times10^4\Omega$.

Results of the evaluation of the developing device 10 will be explained next. In the experiment, a printing performance of the image forming apparatus 20 was evaluated with a method similar to that in the first embodiment, and an explanation thereof is omitted. Further, the properties (the blurred image and the fog) were evaluated with a method similar to that in the first embodiment, and an explanation thereof is omitted.

As shown in FIGS. 10 and 11, the table and the graph show the results of examples 13 to 24 (Ex. 13 to Ex. 24) and comparative examples 3 and 4 (CEx. 3 and CEx. 4). The examples 13 to 24 used the developing rollers Dv1 to Dv4 as the developing roller 13. In the examples 13 to 24 (Ex. 13 to Ex. 24), when the toner supplying roller Sp0-C with the low electrical resistivity was used as the toner supplying roller 14, i.e., combinations of the developing rollers Dv1 to Dv4 and the toner supplying roller Sp0-C, it was possible to obtain a good result with respect to the density variance (the blurred image), and was not possible to obtain a good result with respect to the fog.

On the other hand, when the toner supplying rollers Sp1-C to Sp3-C with the middle electrical resistivity were used as the toner supplying roller 14, i.e., combinations of the developing rollers Dv1 to Dv4 and the toner supplying rollers Sp1-C to Sp3-C, it was possible to obtain a good result with respect to both the density variance (the blurred image) and the fog.

As shown in FIG. 10, the comparative examples 3 and 4 (CEx. 3 and CEx. 4) used the developing rollers Dv5 and Dv6 as the developing roller 13. In the comparative examples 3 and 4 (CEx. 3 and CEx. 4), when the toner supplying roller Sp0-C with the low electrical resistivity was used as the toner supplying roller 14, or the toner supplying rollers Sp1-C to Sp3-C with the middle electrical resistivity were used as the toner supplying roller 14, i.e., combinations of the developing rollers Dv5 and Dv6 and the toner supplying rollers Sp0-C to Sp3-C, it was possible to obtain a good result with respect to the fog, and was not possible to obtain a good result with respect to the density variance.

In the experiment, the developing rollers Dv5 and Dv6 had the large remaining potential and were capable of accumulating a large amount of electric charges. Accordingly, it was possible to prevent electric charges of the toner 21 from escaping, thereby obtaining the good result with respect to the fog. However, when the developing rollers Dv5 and Dv6 were rotated at a high speed, it was difficult to quickly generate the electric filed at the contact portion (the nip portion) relative to the toner supplying roller 14. Accordingly, it was difficult to stably generate the electric filed and supply the toner 21, thereby causing the density variance.

On the other hand, the developing rollers Dv1 to Dv4 used in the examples 13 to 24 (Ex. 13 to Ex. 24) had the small remaining potential. When the developing rollers Dv1 to Dv4 were rotated at a high speed as the developing roller 13, it was possible to stably generate the electric filed and supply the toner 21, thereby maintaining a stable density. When the developing rollers Dv1 to Dv4 were combined with the toner supplying rollers Sp1-C to Sp3-C having the middle electrical resistivity, it was possible to prevent the toner electric charges from discharging due to the electric field, or prevent the toner electric charges from leaking to the toner supplying roller 14 and lowering, thereby making it possible to maintain the good result with respect to the fog.

Further, in the embodiment, the toner supplying rollers Sp1-C to Sp3-C contained a small amount of carbon black in the soft foamed member for functioning as a reinforcing component. Accordingly, when the toner supplying rollers Sp1-C to Sp3-C were pressed against a peripheral component for an extended period of time, it was possible to prevent the toner supplying rollers Sp1-C to Sp3-C from being plastically deformed.

In the embodiment, the urethane foamed member was used in the experiment as the elastic foamed layer 14*b* having the electric resistivity between $1.9\times10^4$ and $8.8\times10^7\Omega$. As described above, in theory, when the elastic foamed layer 14*b* has the electric resistivity between $1.9\times10^4$ and $1.0\times10^8\Omega$, it is possible to obtain the good result.

In the embodiment, when the developing roller 13 as the developer supporting member has the remaining potential between 1 V and 36 V, it is possible to form an image with good quality with respect to the density variation and the fog.

Further, in the embodiment, the developing roller 13 as the developer supporting member has the electric resistivity between $4.35\times10^6$ and $4.32\times10^8\Omega$, it is possible to form an image with good quality with respect to the density variation and the fog.

As described above, in the embodiment, the toner supplying roller 14 includes the elastic foamed layer 14*b* having the electrical resistivity between $1.9\times10^4$ and $8.8\times10^7\Omega$. Accordingly, it is possible to provide the developing device 10 with the good performance with respect to both the density variance (the blurred image) and the fog.

In the first and second embodiments described above, the color printer of the electro-photography type is explained as the image forming apparatus, and the present invention may be applicable to a copier, a facsimile, and a MFP (Multi Function Product).

The disclosure of Japanese Patent Application No. 2009-275034, filed on Dec. 3, 2009, is incorporated in the application.

While the invention has been explained with reference to the specific embodiments of the invention, the explanation is illustrative and the invention is limited only by the appended claims.

What is claimed is:

1. A developing device comprising:

a developer supplying member for supplying developer; and a developer supporting member for supplying the developer supplied from the developer supplying member onto a static latent image supporting member, wherein said developer supplying member includes a foamed member containing a conductive agent, said foamed member has foam cells so that a first electron conductive agent is attached to walls of the foam cells, said foamed member includes an outer circumferential portion having an electrical resistivity between $1.2\times10^4$ and $1.0\times10^8\Omega$, and said developer supporting member has a remaining potential between 1 and 36 V after 0.1 second after a corona discharge device applied a voltage of 5 kV to generate corona discharge for charging a surface of the developer supporting member from a distance of 1 mm from the surface.

2. The developing device according to claim 1, wherein said outer circumferential portion has the electrical resistivity between $1.2\times10^4$ and $7.6\times10^7\Omega$.

3. The developing device according to claim 1, wherein said outer circumferential portion includes a base member containing an ion conductive agent.

4. The developing device according to claim 1, wherein said outer circumferential portion includes a base member containing carbon black, said outer circumferential portion having the electrical resistivity between $1.9\times10^4$ and $1.0\times10^8\Omega$.

5. The developing device according to claim 1, wherein said developer supplying member includes a core metal portion as a rotational shaft, said outer circumferential portion covering an outer circumferential surface of the core metal portion.

6. The developing device according to claim 1, wherein said outer circumferential portion is formed of a urethane foam.

7. The developing device according to claim 6, wherein said urethane foam contains carbon black.

8. The developing device according to claim 1, wherein said outer circumferential portion includes a base member containing carbon black, said outer circumferential portion having the electrical resistivity between $1.9\times10^4$ and $8.8\times10^7\Omega$.

9. The developing device according to claim 1, wherein said developer supporting member is arranged to contact with the outer circumferential portion.

10. The developing device according to claim 1, wherein said developer supporting member includes a core metal portion as a rotational shaft, an elastic layer covering an outer circumferential surface of the core metal portion, an intermediate layer covering an outer circumferential surface of the elastic layer, and a surface layer covering an outer circumferential surface of the intermediate layer.

11. The developing device according to claim 10, wherein said surface layer contains a conductive agent.

12. The developing device according to claim 1, wherein said developer supporting member has an electrical resistivity between $4.35\times10^6$ and $4.32\times10^8\Omega$.

13. A developing device comprising:

a static latent image supporting member;

a developer supporting member for supplying developer to the static latent image supporting member; and a developer supplying member for supplying the developer to the developer supporting member, said developer supplying member including a core metal portion as a rotational shaft and a foamed member covering an outer circumferential surface of the core metal portion, wherein said foamed member contains a conductive agent, said foamed member has foam cells so that carbon black is attached to walls of the foam cells, and said developer supporting member has a remaining potential between 1 and 36 V after 0.1 second after a corona discharge device applied a voltage of 5 kV to generate corona discharge for charging a surface of the developer supporting member from a distance of 1 mm from the surface.

14. An image forming apparatus comprising the developing device according to claim 1.

15. An image forming apparatus comprising the developing device according to claim 13.

16. The developing device according to claim 1, wherein said conductive agent is a second electron conductive agent.

17. The developing device according to claim 1, wherein said first electron conductive agent is carbon black.

18. The developing device according to claim 1, wherein said conductive agent is an ion conductive agent.

19. The developing device according to claim 18, wherein said first electron conductive agent is carbon black.

* * * * *